US005235923A

United States Patent [19]

Kojima et al.

[11] Patent Number: 5,235,923

[45] Date of Patent: Aug. 17, 1993

[54] DOUBLE SHELLED ROLLED HEMMING DEVICE AND ENDLESS FEEDER

[75] Inventors: Hiroshi Kojima; Takeshi Yoshida, both of Tochigi, Japan

[73] Assignee: The Singer Company N.V., Curacao, Netherlands Antilles

[21] Appl. No.: 868,809

[22] Filed: Apr. 15, 1992

[30] Foreign Application Priority Data

Aug. 12, 1991 [JP] Japan ..... 3-071242[U]

[51] Int. Cl.[5] ..... D05B 35/04; D05B 35/10

[52] U.S. Cl. ..... 112/141; 112/143; 112/147; 112/153; 112/322

[58] Field of Search ..... 112/51, 52, 63, 120, 112/121.18, 136, 139, 141-144, 147, 153, 303, 306, 152, 304, 322

[56] References Cited

U.S. PATENT DOCUMENTS

| | | | |
|---|---|---|---|
| 1,857,058 | 5/1932 | Maier | 112/136 |
| 2,869,494 | 1/1959 | Anderson et al. | 112/147 X |
| 3,922,978 | 12/1975 | Smith | 112/147 |
| 4,572,094 | 2/1986 | Taddicken | 112/322 |
| 4,653,414 | 3/1987 | Harrington | 112/142 |
| 4,660,486 | 4/1987 | Arbter | 112/143 |
| 4,714,036 | 12/1987 | Raisin et al. | 112/147 |
| 4,924,787 | 5/1990 | Hansberry | 112/142 |

FOREIGN PATENT DOCUMENTS

| | | | |
|---|---|---|---|
| 2016665 | 4/1987 | Japan | 112/136 |
| 2072393 | 4/1987 | Japan | 112/136 |

*Primary Examiner*—Clifford D. Crowder
*Assistant Examiner*—Ismael Izaguirre

[57] ABSTRACT

A device for producing a rolled hemming of a cloth including a rolling tool for rolling an edge of said cloth therein. The tool has an outer shell member and an inner shell member. A spiral shaped gap is formed between the shells for feeding the cloth edge therethrough. The gap has an entry opening for receiving the cloth edge and a discharge opening from which the cloth edge is discharged. The width of said gap decreases from the entry opening to the discharge opening. The tool is fixedly mounted upstream of a presser foot of a sewing machine with respect to a feeding direction of the cloth and downstream of the presser foot with respect to a cloth edge rolling direction. A cloth feeding mechanism for coercively tucking the cloth into the rolling tool in the rolling direction includes an endless sliding member for clamping the cloth edge at a portion of the shells whereby a portion of the cloth is exposed out of both shell members; and a rotary driving mechanism for driving the endless sliding member.

2 Claims, 6 Drawing Sheets

DOUBLE SHELLED ROLLED HEMMING DEVICE AND ENDLESS FEEDER

BACKGROUND OF THE INVENTION

The present invention relates to a device for producing a rolled hemming of a cloth.

DESCRIPTION OF THE RELATED ART

Rolled hemming is generally employed by a sewing machine for preventing a frayed cut edge or to provide a good finish at a cut edge of a cloth to be sewn. A rolling tool such as disclosed in Japanese Utility Model Publication No. 61-36225 is conventionally used. This tool comprises outer and inner shells spaced at a predetermined interval wherein a gap having a spiral cross section is formed therebetween.

The rolled hemming is carried out after inserting the cloth edge into the rolling tool using the feed dog of the sewing machine to advance the cloth.

However, in the conventional rolling tools, the rolled hemming operation only utilized advancement of the cloth using the feed dog of the sewing machine while at the same time leaving the rolling thereof to its own course. As a consequence the cloth was not rolled enough for sewing which resulted either producing hemming of variable width or seams liable to be expelled out of the rolled portion. Consequently, in order to utilize the conventional rolling tool in sewing a skilled operator is required to supervise the operation and manually adjust the rolled state so that the sewing operation is carried out efficiently.

SUMMARY OF THE INVENTION

In view of the conventional technical problems, it is a primary object of the present invention to provide a rolled hemming device utilizing a rolling tool fixedly mounted upstream a presser foot of a sewing machine with respect to a feeding direction of the cloth, and downstream of the presser foot with respect to a cloth edge rolling direction. The tool has outer and inner shell members. A spiral gap is formed between the shells to feed the cloth edge therethrough. The gap has an entry opening for receiving the cloth edge and a discharge opening from which the cloth is discharged. The width of the gap decreases from the entry opening to the discharge opening. A cloth feeding mechanism for coercively tucking the cloth into the tool in the rolling direction includes an endless sliding member for clamping the cloth edge at a portion of the shells whereby a portion of the cloth is exposed out of both shell members. A rotary driving mechanism drives the sliding member. The tool includes curved backward outer and inner shell members having a gap therebetween and curved forward outer and inner shell members having a gap therebetween and projecting toward the presser foot. The tool is disposed on the feeding side of the cloth. The backward inner and outer shell members are related to the forward inner and outer shell members respectively. The endless sliding member of the cloth feeding mechanism clamps the cloth between the base portion of the forward inner shell member and itself. A driving pulley is fixedly mounted on a shaft which is rotated by the rotary drive mechanism. A driving arm is swingably supported by the shaft at the middle portion thereof. Another pulley is supported at the tip end of the driving arm and is freely rotatable thereabout. A belt wound around the driving and free pulley is provided for clamping the cloth.

The sewing operation begins when the cloth edge is inserted into the spiral gap formed between the outer and inner shell members. The cloth is fed by the feed dog of the sewing machine and at the same time the endless sliding member is driven by the rotary drive mechanism to coercively tuck the hem portion of cloth edge into the spiral gap of the rolling tool and clamps the hem portion of cloth edge at the portion where the cloth is exposed out of the shell members in the rolling direction. In this way, the cloth is sewn with a rolled hem of a predetermined width by combination of the feeding by the feed dog of the sewing machine and the tucking in by the cloth feeding mechanism in the rolling direction.

The cloth edge which is bent and rolled as it passes through the gap between the curved backward inner and outer shell members further enters the gap between the curved forward inner and outer shell members so as to be well rolled.

At that time the endless sliding member of the cloth feeding mechanism clamps the cloth between the base portion of the forward inner shell member and itself and coercively tucks the same into the spiral gap in the rolling direction. Furthermore, the driving pulley fixedly mounted on the shaft is driven by the rotary drive mechanism so as to drive the belt wound around the driving and free pulleys and the driving arm is turned so as to clamp the cloth by the belt whereby the cloth can be coercively tucked in the rolling direction.

DESCRIPTION OF PREFERRED EMBODIMENTS

Figure 1:
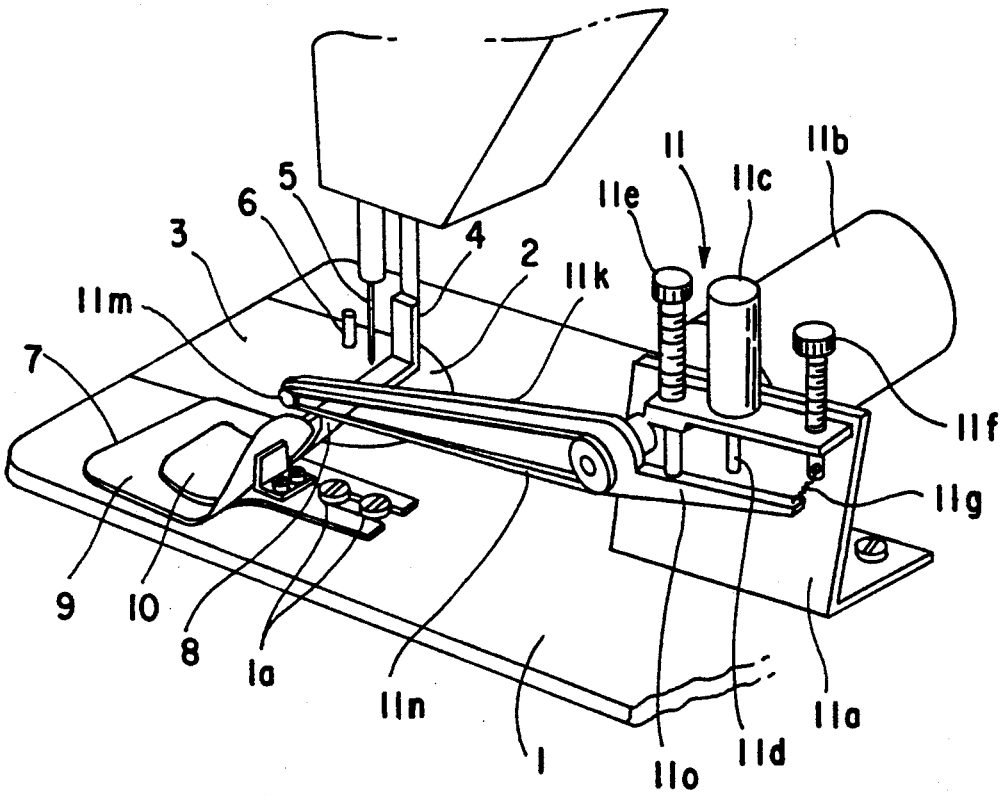
FIG. 1 is a perspective view showing a rolled hemming device according to the present invention.

In FIG. 1, denoted at 1 is a bed of the sewing machine, 2 is a throat plate, 3 is a bed slide, 4 is a presser foot, 5 is a needle, 6 is a cloth end detection sensor on the bed slide 3, which is connected to a control circuit in a controller box, not shown. Denoted at 7 is a rolling tool for rolling the hem portion of a cloth edge and 11 is a cloth feeding mechanism which coercively feeds the cloth in the direction across the feeding direction thereof. The cloth is fed to the rolling tool 7 by the feed dog of the sewing machine.

Figure 2:
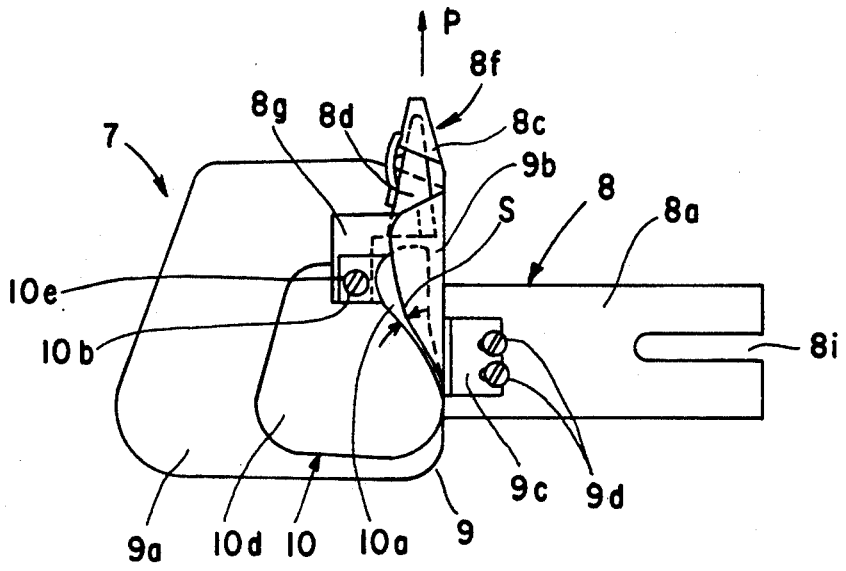
FIG. 2 is a plan view showing the rolling tool of FIG. 1.
Figure 3:
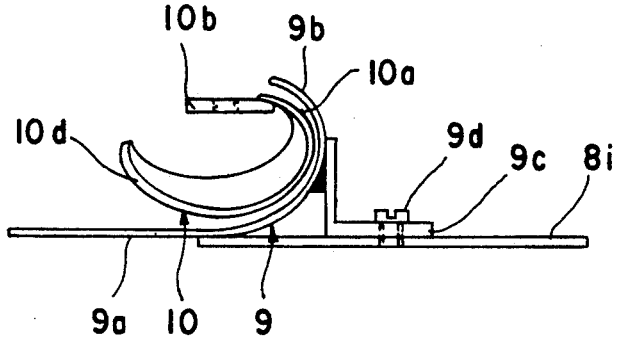
FIG. 3 is a front view showing backward inner and outer shell members of the rolling tool in FIG. 1.
Figure 4:
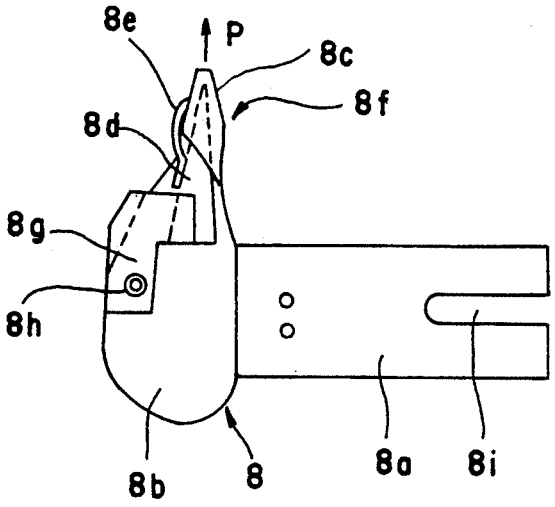
FIG. 4 is a plan view showing the forward inner and outer shell members in FIG. 1.
Figure 5:
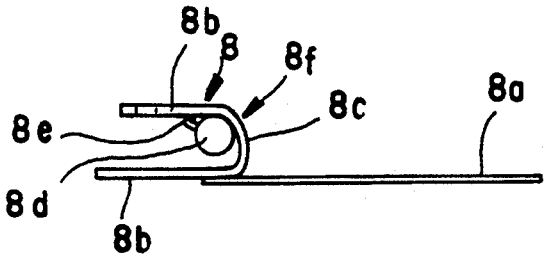
FIG. 5 is a rear view showing the forward inner and outer shall members in FIG. 1.

The rolling tool 7 as shown in FIG. 2 comprises forward inner and outer shell member 8, a backward outer shell member 9 and a backward inner shell member 10. The forward inner and outer shell member 8, as shown in FIG. 4 and 5, comprise a flat fitting portion 8*a* which is fixedly mounted on the bed 1 of the sewing machine. A flat portion 8*b* extends toward the feeding side of the cloth and is connected to another end of the fitting portion 8*a*. A portion of the flat portion 8*b* partially extending toward the direction P to which the cloth is sent out is bent upward and curved conically so as to form a roll-shell shaped portion (forward outer shell) 8*c* having a reduced diameter toward the tip end thereof.

The forward inner and outer shell member 8 has a guide 8*d* fixedly supported by a wiry supporting member 8*e* inside the roll-shell shaped portion 8*c*. Portion 8*c* is a conical forward inner shell member extending inside the roll-shell shaped portion 8*c* at a predetermined interval therefrom. The guide 8*d* has a distal end diameter of which is gradually reduced to the tip end thereof and extends overlapping with the reduced tip end of the rolling shaped portion 8*c* and a base portion which projects from the roll-shell shaped portion 8*c*. A cloth rolling portion 8*f* having a spiral gap is defined between the roll-shaped portion 8*c* and the curved surface of the guide 8*d*. Fixedly mounted on the upper surface of the base portion of the guide 8*d* is one end of a supporting plate 8*g*, which has a L-shape. A screw hole 8*j* is disposed at the other end thereof.

Figure 6:
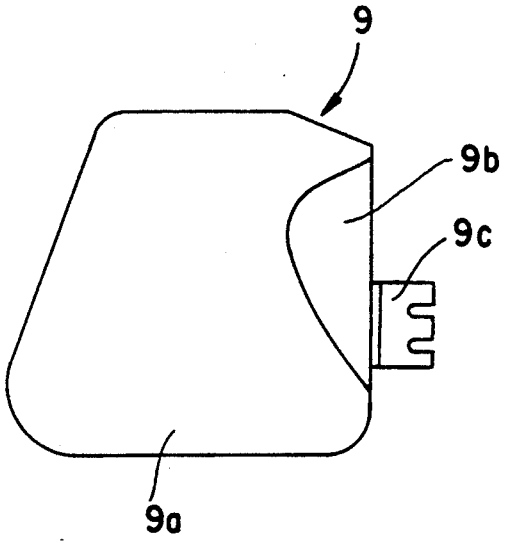
FIG. 6 is a plan view showing the backward outer shell member in FIG. 1.
Figure 7:
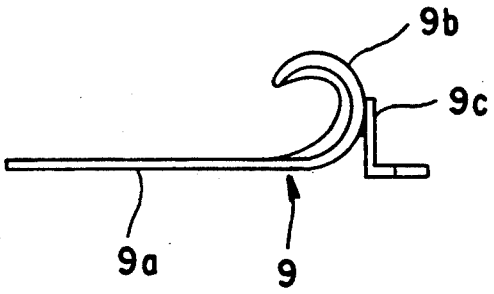
FIG. 7 is a rear view showing the backward outer shell member in FIG. 1.

As shown in FIGS. 6 and 7, the backward outer shell member 9 has a flat portion 9*a*, which is curved upward over 180 degrees at a smoothly convex edge thereof so as to form a roll-up portion 9*b* having a curvature which is gradually reduced toward the tip end thereof. It is fixedly mounted on the upper surface of the flat fitting portion 8*a* of the forward inner and outer shell member 8 by way of an L-shaped bracket 9*c* fixed to an outer surface of the roll-up portion 9*b*.

Figure 8:
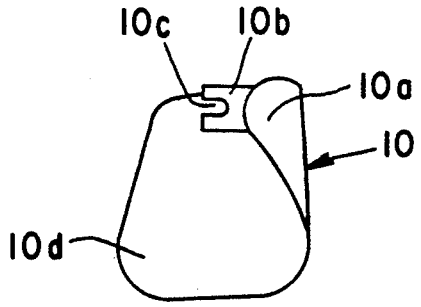
FIG. 8 is a plan view showing a backward inner shell member in FIG. 1.
Figure 9:
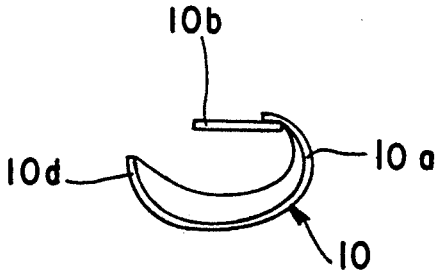
FIG. 9 is a rear view showing the backward inner shell member in FIG. 1.

The backward inner shell member 10 is rolled up so as to have an upward curved edge 10*d* and the opposite convex edge curved upward about 180 degrees forming a curved portion 10*a*. The diameter of the curved portion is reduced toward the tip end thereof as shown in FIGS. 8 and 9. Fixed to the upper surface of the curved portion 10*a* is a fitting plate 10*b* which has a groove 10*c* extending horizontally and is fixedly mounted on the supporting plate 8*g* of the forward inner and outer shell member 8.

The arrangement of the rolling tool 7, which comprises the forward inner and outer shell member 8, the backward outer shell member 9 and the backward inner shell member 10, is described below with reference to FIG. 2.

The forward inner and outer shell member 8 is fixedly mounted on the bed 1 by the screw 1*a* inserted through the grooved 8*i* of the flat fitting portion 8*a* in order to position the tip end of the cloth rolling portion 8*f* in the vicinity of the rear end of the presser foot 4 with respect of the feeding direction of the cloth.

The backward outer shell member 9 is fixedly mounted on the flat fitting portion 8*s* by the screw 9*d* inserted through the bracket 9*c* so that the roll up portion 9*b* may slightly cover the base portion of the guide 8*d* of the forward inner and outer shell member 8. The roll up portion 9*b* is continued to the roll-shell shaped portion 8*c*. The backward inner shell member 10 having the fitting plate 10*b* is placed on and fixed to the upper surface of the supporting plate 8*g* by a screw 10*e* inserted through the screw hole 8*h* and the groove 10*c* so as to form a spiral gap between the backward inner shell member 10 and the backward outer shell member 9. The curved portion 10*a* extends to the base portion of the guide 8*d*. The cloth is inserted into a gap S between the backward inner shell member 10 and the backward outer shell member 9 at the base portions thereof. The gap gradually expands toward the other end thereof between the upward curved edge 10*d* of the backward inner shell member 10 and the flat portion 9*a* of the backward outer shell member 9 to facilitate the positioning of the cloth for sewing.

Inasmuch as the rolling tool 7 is constructed as set forth above, the edge of the cloth to be sewn inserted into the gap S is primarily rolled over 180 degrees between the outer surface of the curved portion 10*a* and the inner surface of roll up portion 9*b*. Thereafter the edge is rolled up completely to be fit for hemming as it is guided on the roll up portion 9*b* of the backward outer shell member 9 at the outer side thereof to the gap between the roll-shell shaped portion 8*c* and the guide 8*d*.

The cloth feeding mechanism 11 for coercively tucking the cloth into the rolling tool 7 is described below with reference to FIG. 1, 10, 11 and 12.

Denoted at 11*a* is a bracket comprising a bottom plate having a Z-shaped cross section which is fixed to the bed 1 of the sewing machine. A direct current motor 11*b* that serves as a rotary driving mechanism is fixed to the side plate thereof. A driving mechanism 11*c* such as an electromagnetic solenoid or pneumatic cylinder is fixed to the top plate thereof. A driving arm restriction screw 11*e* is engaged therewith as is an adjusting screw 11*f*. A driving pulley 11*i* is fixed at the tip end of the motor shaft 11*h* projecting from the side plate of the bracket 11*a*. A driving arm 11*k* extending over the guide 8*d* of the forward inner and outer shell members 8 is swingably provided inside the driving pulley 11*i*. The middle portion of the arm is supported by a bearing 11*j*. A pulley 11*m* is supported at the tip end of the driving arm 11*k* and is freely rotatably therearound. A belt 11*n* serving as a sliding member is wound around the driving and free pulley 11*i* and 11*m*.

A driving arm restriction screw 11*e* and a plunger 11*d* of the driving mechanism 11*c* are disposed above the upper surface of the tail portion 11*o* of the driving arm 11*k*. A driving arm restriction screw 11*e* on the inner side and a plunger 11*d* on the tail side are attached to the tail portion 11*o* at the tip ends thereof. A tension spring 11*g* is provided between the tail portion 11*o* of the driving arm 11*k* and the tip portion of the adjusting screw 11*f* to bias the driving arm 11*k* in the counterclockwise direction. The lower surface of the belt 11*n* elastically contacts the upper surface of the base portion of the guide 8*d* exposed from the roll-shell shaped portion 8*c*, i.e. the forward outer shell member and the roll up portion 9*b* of the backward outer shell member 9. Consequently, the exposed portion of the guide 8*d* extending from the roll-shell shaped portion 8*c* and the roll up portion 9*b* is positioned at the central portion of the central axis of the inner shell formed by the guide 8*d* and the backward inner shell member 10.

The cloth feeding mechanism 11 thus constructed is operated as follows.

When the driving mechanism 11*c* is inoperative, the driving arm 11*k* is turned counterclockwise about the bearing 11*j* by the tension spring 11*g* so that the free pulley 11*m* is in the lower position and the lower surface of the belt 11*n* elastically contacts the upper surface of the base portion of the guide 8*d*. The pressure applied to the guide 8*d* by the belt 11*n* can be adjusted by turning the driving arm restriction screw 11*e* and the adjusting screw 11*f* relative to the bracket 11*a*. When the motor 11*b* is operated and rotates while the belt 11*n* elastically contacts the upper surface of the guide 8*d*, the belt 11*n* is driven to slide in the direction of the arrow Y substantially at right angles to the central axis of the guide 8*d* while slidably contacting the same.

When the driving mechanism 11*c* is operated, the plunger 11*d* is elongated to press down the tail portion 11*o* of the driving arm 11*k* so that the driving arm 11*k* is turned clockwise against the tension of the tension spring 11*g* to thereby separate the belt 11*n* from the guide 8*d*.

Figure 13:
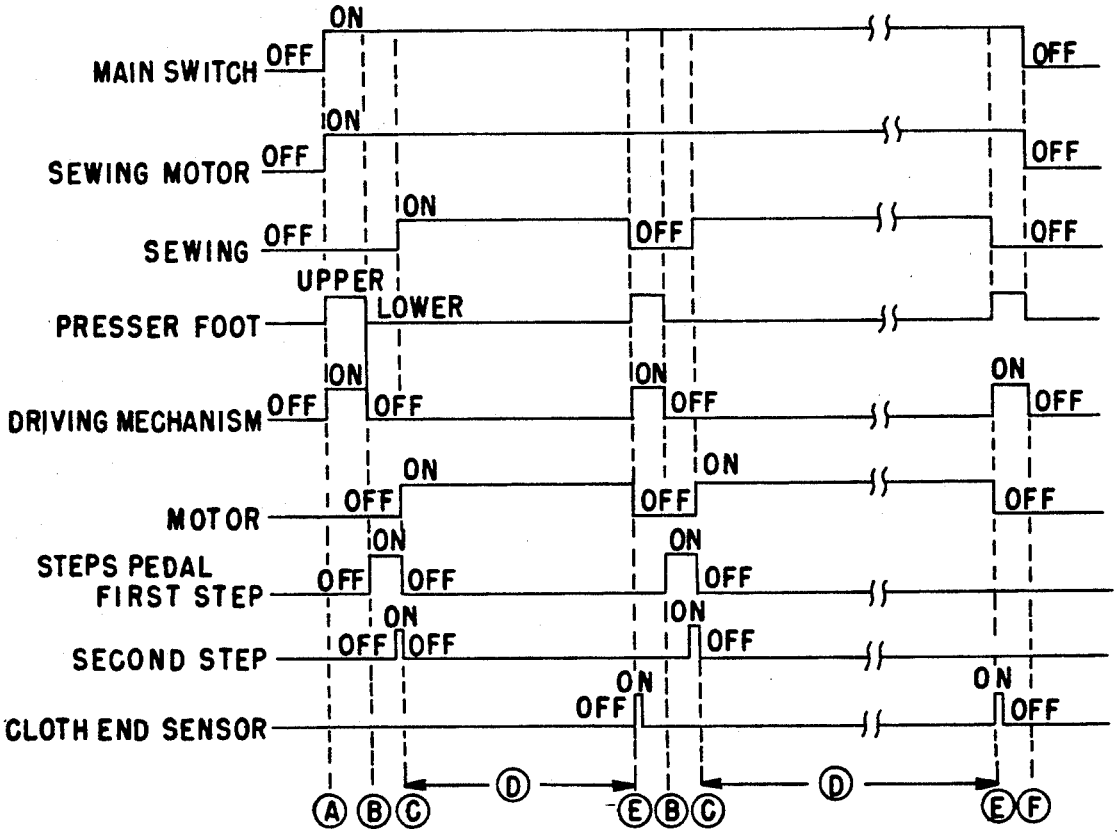
FIG. 13 is a block diagram showing a timing chart of the sewing machine operation in FIG. 1.

The operation of the rolled hemming device is described below with reference to FIG. 13.

When an operator turns on a main switch, a sewing motor rotates upon reception of a control signal from a control circuit of a controller box, (all of which are not shown in the figure) so that the presser foot 4 is raised.

Figure 10:
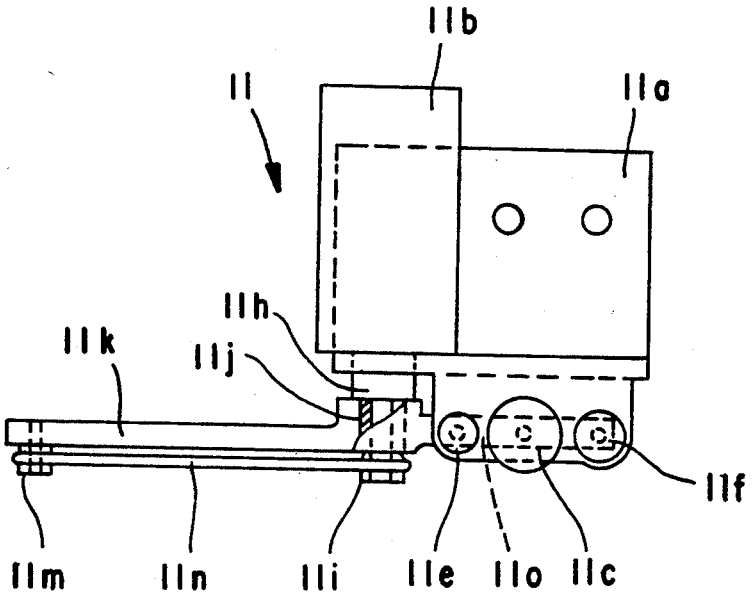
FIG. 10 is a plan view showing a cloth feeding mechanism in FIG. 1.
Figure 11:
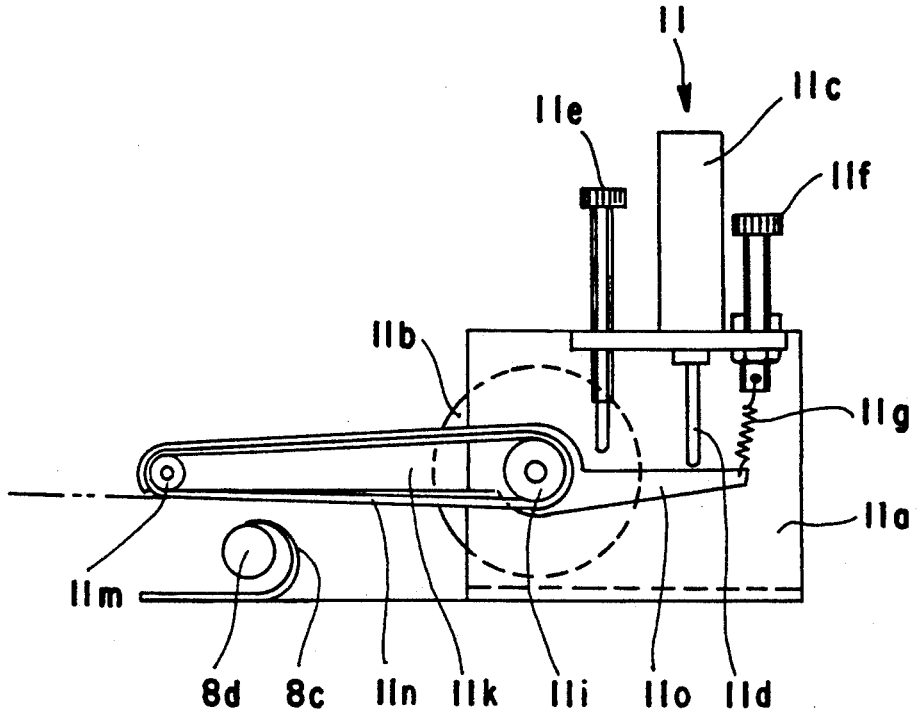
FIG. 11 is a rear view showing the cloth feeding mechanism in FIG. 1.
Figure 12:
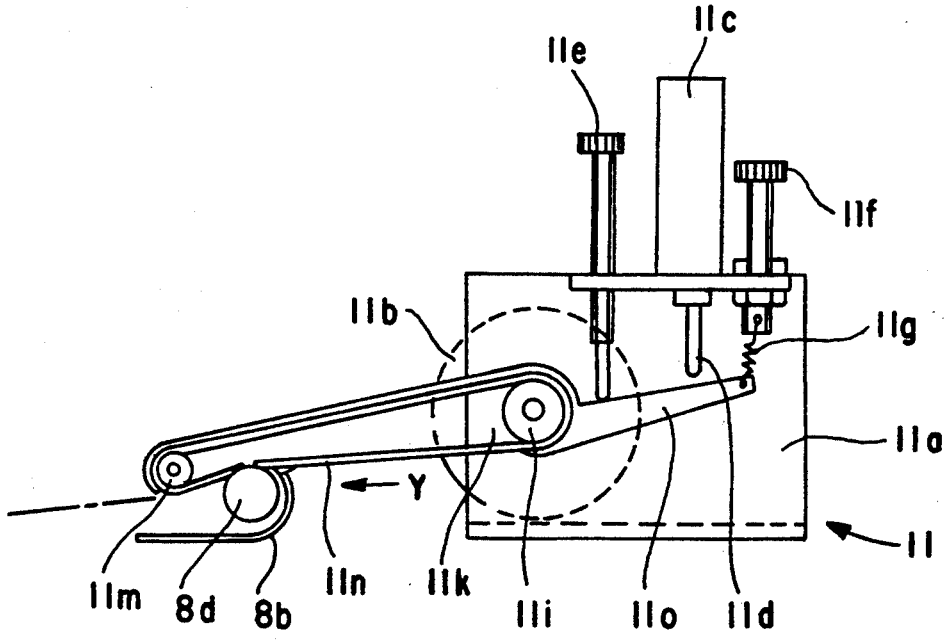
FIG. 12 is a view used in explaining the operation of the cloth feeding mechanism is FIG. 1.

At the same time, as shown in FIG. 10, the driving mechanism 11*c* of the cloth feeding mechanism 11 operates in a forward direction so as to press down the tail portion 11*o* of the driving arm 11*k* by the plunger 11*d* and to turn the driving arm 11*k* about the shaft 11*h* of the motor 11*b* clockwise. As a result, the free pulley is raised so that the belt 11*n* is separated from the upper surface of the base portion of the guide 8*d* of the rolling tool 7.

The operator then inserts the edge of the cloth to be sewn into the gap S formed between the backward outer shell member 9 and the backward inner shell member 10 of the rolling tool 7 so as to preliminarily roll the cloth, thrust out the same in a rolled shape from the tip portion of the forward inner and outer shell member 8, and place the same beneath the presser foot 4.

When the operator steps on a pedal to place it in the first pedal position, (not shown), the control circuit produces a second signal so that the presser foot 4 is lowered, the driving mechanism 11*c* returns to its inoperative position, the plunger 11*d* is separated from the tail portion 11*o* of the driving arm 11*k*, the driving arm 11*k* is turned counterclockwise by the tension spring 11*g* and the lower surface of the tip portion of the belt 11*n* elastically contacts the cloth wound around the base portion of the guide 8*d* of the rolling tool 7 with a given pressure.

When the operator steps further on the pedal to place it in the second pedal position, the sewing machine starts to sew. At the same time, the motor 11*b* is rotated at a given speed, so that the belt 11*n* which is pressing the cloth on the base portion of the guide 8*d* is driven in the direction of Y so as to thrust the edge of the cloth leftward in FIG. 12 and roll the same.

When the operator releases the pedal thereafter, a signal issued by stepping on the pedal to the second pedal position is stored in the control circuit of the controller box, and the sewing machine automatically continues the rolled hemming operation.

All during this time the edge of the cloth to be sewn on the guide 8*d* is rolled in the cloth rolling portion 8*f* for rolled hemming by the feeding motion of the feed dog of the sewing machine and the leftward thrust by the belt 11*n*, transferred toward the presser foot 4 and is sewn by the needle 5. As a result, a good rolled hemming can be attained automatically by establishing a predetermined relation between the feeding speed of the feed dog of the sewing machine and coercive thrust given by the peripheral speed of the belt 11*n* without manual operation.

When a cloth and detection sensor 6 on the bed slide 3 detects the cloth end as the sewing operation progresses, the sewing machine stops its operation upon reception of the control signal issued by the control circuit of the controller box, the presser foot 4 is raised, the driving mechanism 11*c* operates in forward direction to turn the driving arm 11*k* clockwise and the pulley is raised so that the tip portion of the belt 11*n* is separated from the upper surface of the base portion of the guide 8*d*. The sewing motor 11*b* is then stopped.

When the operator turns off the main switch after completion of a series of rolled hemming operations, the sewing motor stops, the presser foot 4 is lowered, the driving mechanism 11*c* stops to operate, the plunger 11*d* is separated from the tail portion 11*o* of the driving arm 11*k* so that the driving arm 11*k* is turned counterclockwise by the tension of the tension spring 11*g* and the tip portion of the belt 11*n* stops on the base portion of the guide 8*d*.

Thus, the cloth edge is coercively tucked into the rolling tool by an endless sliding member which is a belt rotating at a given speed. A good rolled hem having a predetermined width is produced in cooperation with the feeding action of the feed dog in accordance with the present invention, while eliminating the necessity of using a skilled operator for supervising the operation and manually adjusting the rolled state.

What is claimed is:

1. A device for producing a rolled hemming of a cloth comprising:

a rolling tool for rolling an edge of said cloth therein;

said rolling tool comprising an outer shell member and an inner shell member;

a spiral shaped gap formed between said shells for feeding the cloth edge therethrough, said gap having an entry opening for receiving the cloth edge and a discharge opening from which the cloth edge is discharged, the width of said gap decreasing from the entry opening to the discharge opening.;

said rolling tool fixedly mounted upstream a presser foot of a sewing machine with respect to a feeding direction of the cloth and downsteam of the presser foot with respect to a cloth edge rolling direction;

a cloth feeding mechanism for coercively tucking the cloth into the rolling tool in the rolling direction comprising;

an endless sliding member for clamping the cloth edge at a portion of the shells whereby a portion of the cloth is exposed out of both shell members; and a rotary driving mechanism for driving the endless sliding member.

2. The device of claim 1 wherein said cloth feeding mechanism includes a shaft rotated by said driving mechanism a first pulley secured to the shaft and driven thereby, a driving arm swingably supported in the middle thereof by the shaft and having a tip portion, a second pulley freely rotatable about said tip portion, and a belt wound around both pulleys so that the first pulley causes rotation of the second pulley.

* * * * *